US005292369A

United States Patent [19]

Chung

[11] Patent Number: 5,292,369

[45] Date of Patent: Mar. 8, 1994

[54] AUTOMATIC MACHINE FOR HOT DIPPING GALVANIZATION

[75] Inventor: Chin-Chuan Chung, Chang Hwa Hsien, Taiwan

[73] Assignee: Taiwan Galvanizing Co., Ltd., Taipei, Taiwan

[21] Appl. No.: 868,675

[22] Filed: Apr. 15, 1992

[51] Int. Cl.[5] ..... B05C 3/10

[52] U.S. Cl. ..... 118/696; 118/425; 118/423; 118/500; 134/77; 414/222; 198/346.3

[58] Field of Search ..... 118/696, 423, 425, 429, 118/500; 204/198, 201; 134/76, 77; 414/222; 198/346.3, 468.6, 485.1

[56] References Cited

U.S. PATENT DOCUMENTS

| | | | |
|---|---|---|---|
| 2,341,606 | 2/1944 | Finston | 118/425 |
| 2,738,321 | 3/1956 | Finston | 134/77 |
| 2,826,288 | 3/1958 | Giaier | 198/346.3 |
| 3,301,418 | 1/1967 | Davis | 198/346.3 |
| 3,760,927 | 9/1973 | Zambor | 198/346.3 |
| 3,770,150 | 11/1973 | Clark | 198/346.3 |
| 4,268,206 | 5/1981 | Johnson | 118/425 |
| 5,012,918 | 5/1991 | Acker et al. | 118/425 |

FOREIGN PATENT DOCUMENTS

| | | | |
|---|---|---|---|
| 1128717 | 4/1962 | Fed. Rep. of Germany | 134/77 |
| 2033865 | 5/1980 | United Kingdom | 118/425 |

*Primary Examiner*—W. Gary Jones
*Assistant Examiner*—Todd J. Burns
*Attorney, Agent, or Firm*—Bacon & Thomas

[57] ABSTRACT

An automatic machine for hot dipping galvanization has lower and upper frames to support a slide, an elevator and a control device. The slide consists of two sets of sprocket wheels, each having two sprocket wheels installed at respective ends of each frame controlling a plurality of guide rails via link belts to slide along two slideways. The elevator consists of an elongated elevator hanging on top of the lower frame by means of four guide supports which each have one end connected to the elevator and the other end to a U-shaped rod. Two arcuate plates extending outwards from respective ends of the elevator carry articles to be galvanized into the zinc bath and galvanized articles out of the zinc bath. The control device consists of a central processing unit which controls the entire movement, a motor which controls the slide, and a cylinder which controls the elevator.

3 Claims, 11 Drawing Sheets

AUTOMATIC MACHINE FOR HOT DIPPING GALVANIZATION

BACKGROUND OF THE INVENTION

1. Field of the Invention

This invention relates to an automatic machine for hot dipping galvanization, more particularly to a machine to galvanize small metallic parts in a zinc bath for a predetermined time and to pull the parts outwards from the zinc bath with an automatic system.

2. Related Prior Art

Galvanization of metallic parts is one method to provide them with a protective layer which prevents the parts from corrosion or easily cracking.

Galvanization has been adapted by industry as an anti-corrosive method for a long time. There are many processing steps in galvanization which includes filling, hot dipping, vibration, cleaning and cooling. Among these steps, hot dipping is an important step which requires precise estimation of dipping time which is determined by a worker's experience according to the current procedure and mistakes happen once in awhile. Moreover, zinc disperses poisonous gas in a high temperature atmosphere which is dangerous to the human body if inhaled.

The inventor, in view of this, has invented this invention which is operated automatically.

SUMMARY OF THE INVENTION

It is the primary object of the present invention to provide an automatic machine for hot dipping galvanization which galvanizes articles automatically.

It is another object of the present invention to provide an automatic machine for hot dipping galvanization which increases the quality of galvanization.

It is still another object of the present invention to provide an automatic machine for hot dipping galvanization which requires no manual operation of dipping articles into, as well as picking articles up from a zinc bath.

It is a further object of the present invention to provide an automatic machine for hot dipping galvanization which requires less man power to increase the cost effectiveness.

It is still a further object of the present invention to provide an automatic machine for hot dipping galvanization which is easy to operate.

DETAILED DESCRIPTION OF THE PREFERRED EMBODIMENT

Figure 2:
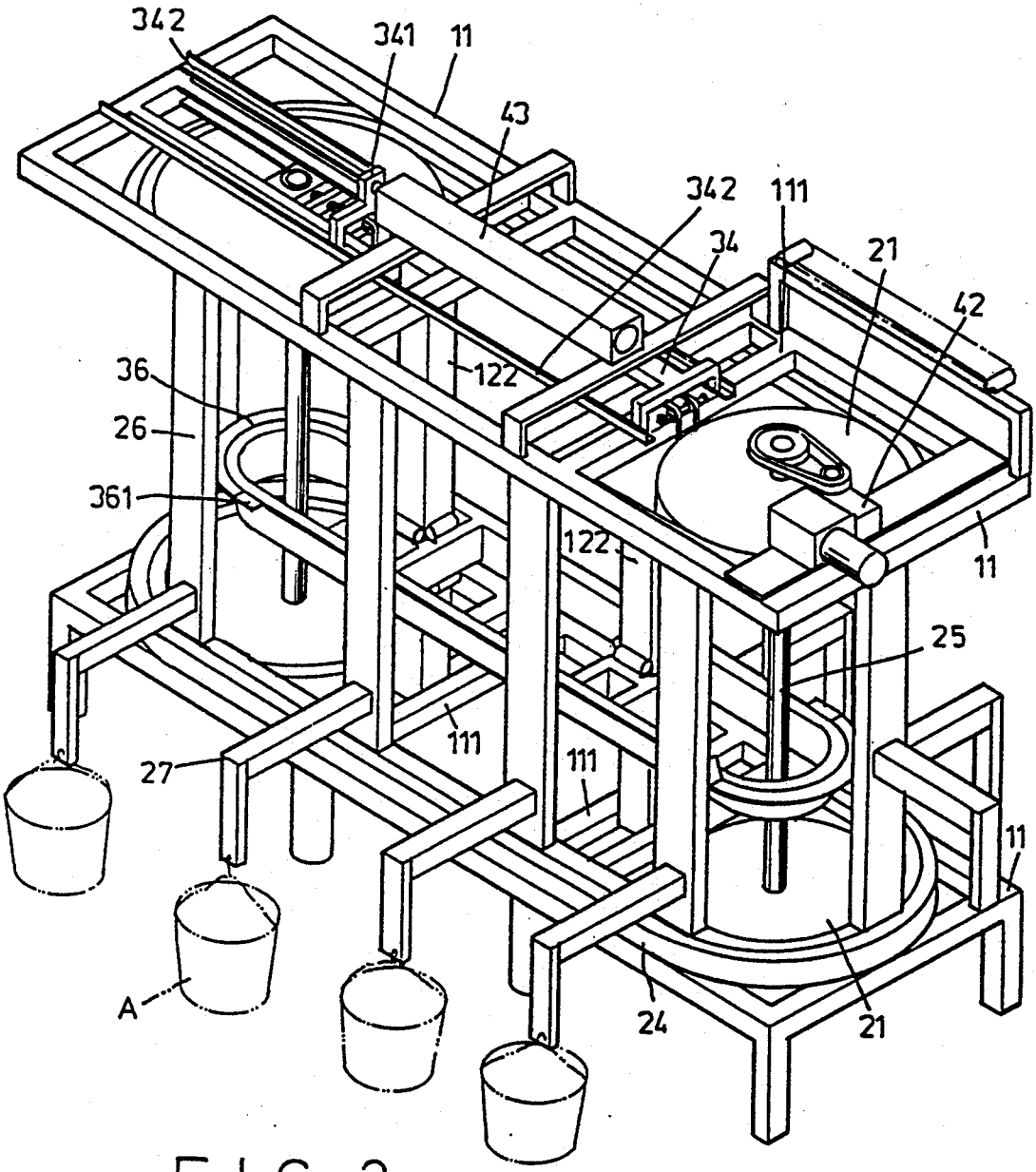
FIG. 2 is a perspective view of the present invention.

Referring now to FIG. 2, there is shown the present invention comprising a main frame having rectangular shaped lower and upper frames 11 having a plurality of beams 111 connected thereon, a slide means, an elevator means, and a control means. The upper frame is standing on the lower frame by means of two rectangular posts 122 having one end secured to the lower frame and the other end secured to the upper frame respectively.

Figures 3A, 3B, 3C:
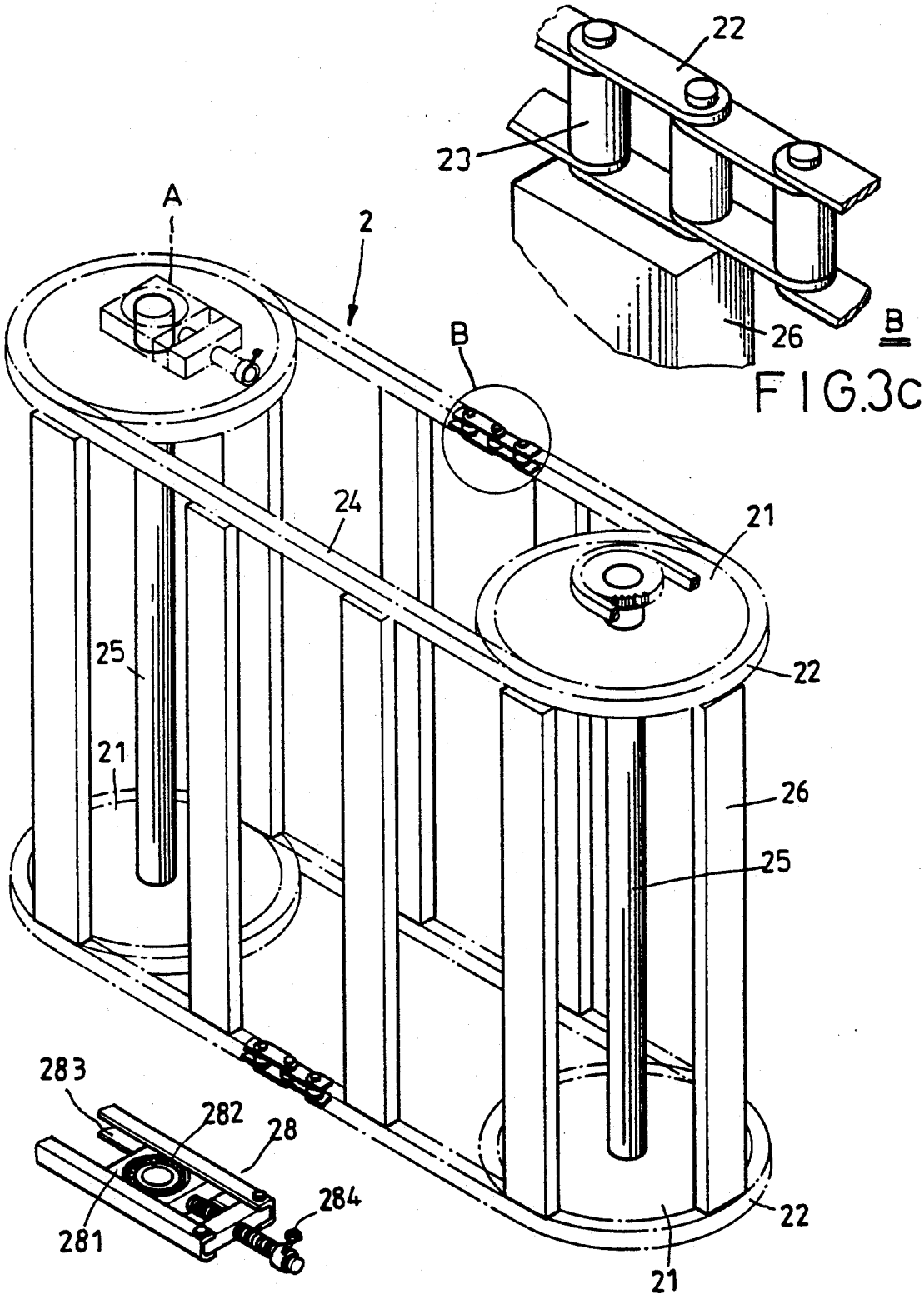
FIG. 3*a* is a perspective view of a slide means of FIG. 2.
FIG. 3*b* is an enlarged view showing the adjusting member illustrated at A in FIG. 3*a*.
FIG. 3*c* is an enlarged view showing the link belt illustrated at B in FIG. 3*a*.
Figure 4:
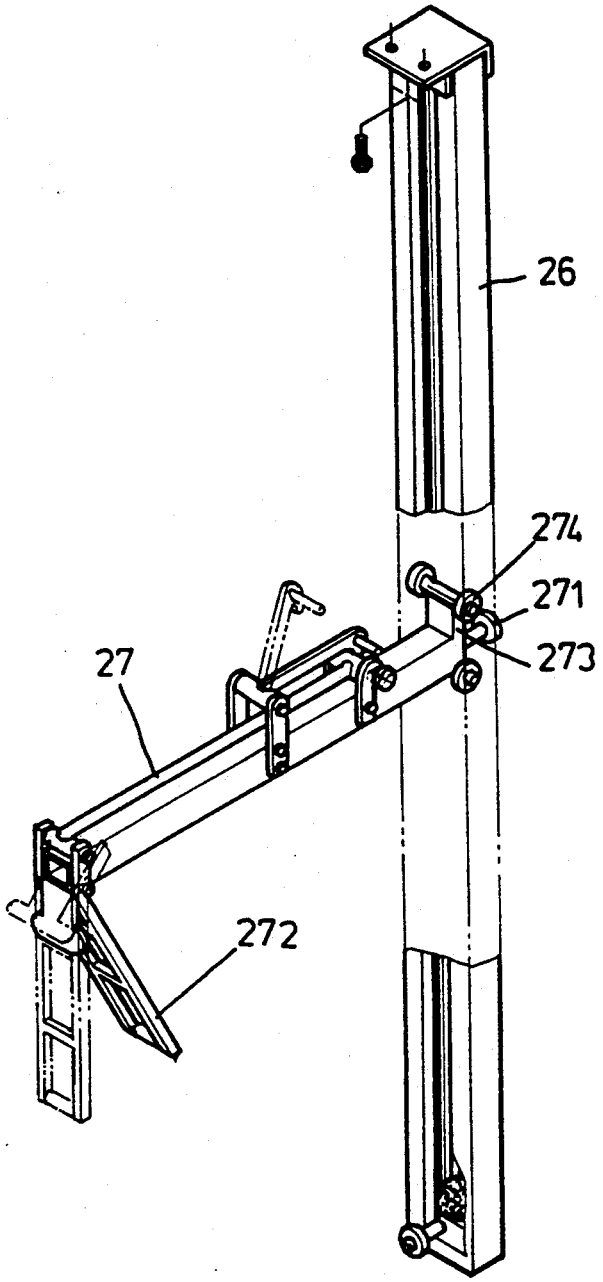
FIG. 4 is a fragmentary view showing a guide rail and an arm of FIG. 3*a*.
Figure 5:
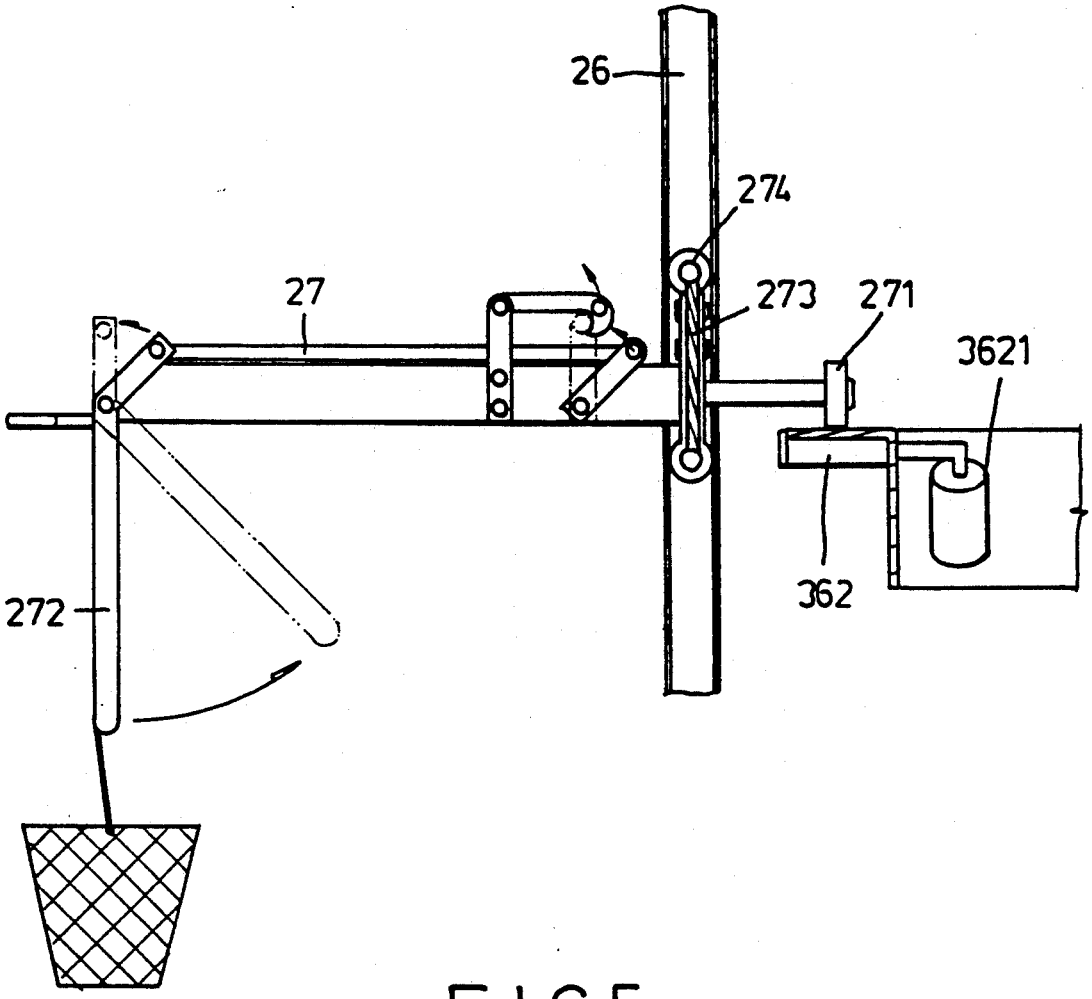
FIG. 5 is an enlarged side view partially in cross-section of a guide rail and an arm of FIGS. 3*a* and 5.

The slide means 2, according to FIG. 3*a*, is composed of two sets of sprocket wheels 21 each set having two sprocket wheels at two ends of the lower and the upper frames 11, respectively; two link belts 22 being engaged with the two sets of sprocket wheels 21, respectively, and a plurality of rollers 23, as shown in FIG. 3*c*, being spaced apart and anchored to one side of each link belt 22 and sliding within two elongated slideways 24, respectively, two shafts 25 having one end of each connected to the center of the lower sprocket wheels and the other end of each connected to the center of the upper sprocket wheels. Also included are a plurality of guide rails 26, each being formed by two U-shaped plates, having one end of each rail 26 secured to the lower link belt and the other end of which secured to the upper link belt respectively. A plurality of arms 27 (see FIGS. 4 and 5) are adapted to hook baskets A filled with articles to be galvanized and conveyed to the zinc bath for dipping. Each arm 27 has a roller 271 extending outwardly from one end and a crank 272 pivotally mounted to the other end. A flange 273 is formed at one end of each arm 27 having four wheels 274 fixedly secured to four corners thereon and is slidably installed within each guide rail 26. An adjusting device 28 (see FIG. 3*b*) is adapted to adjust the distance between two sprocket wheels 21 and has a plate 281 sliding in two rails 283 and an aperture 282 to receive one end of the shaft 25. A screw extending from one end of the device adjusts the distance by screwing the screw to push the shaft outwards.

Figure 6:
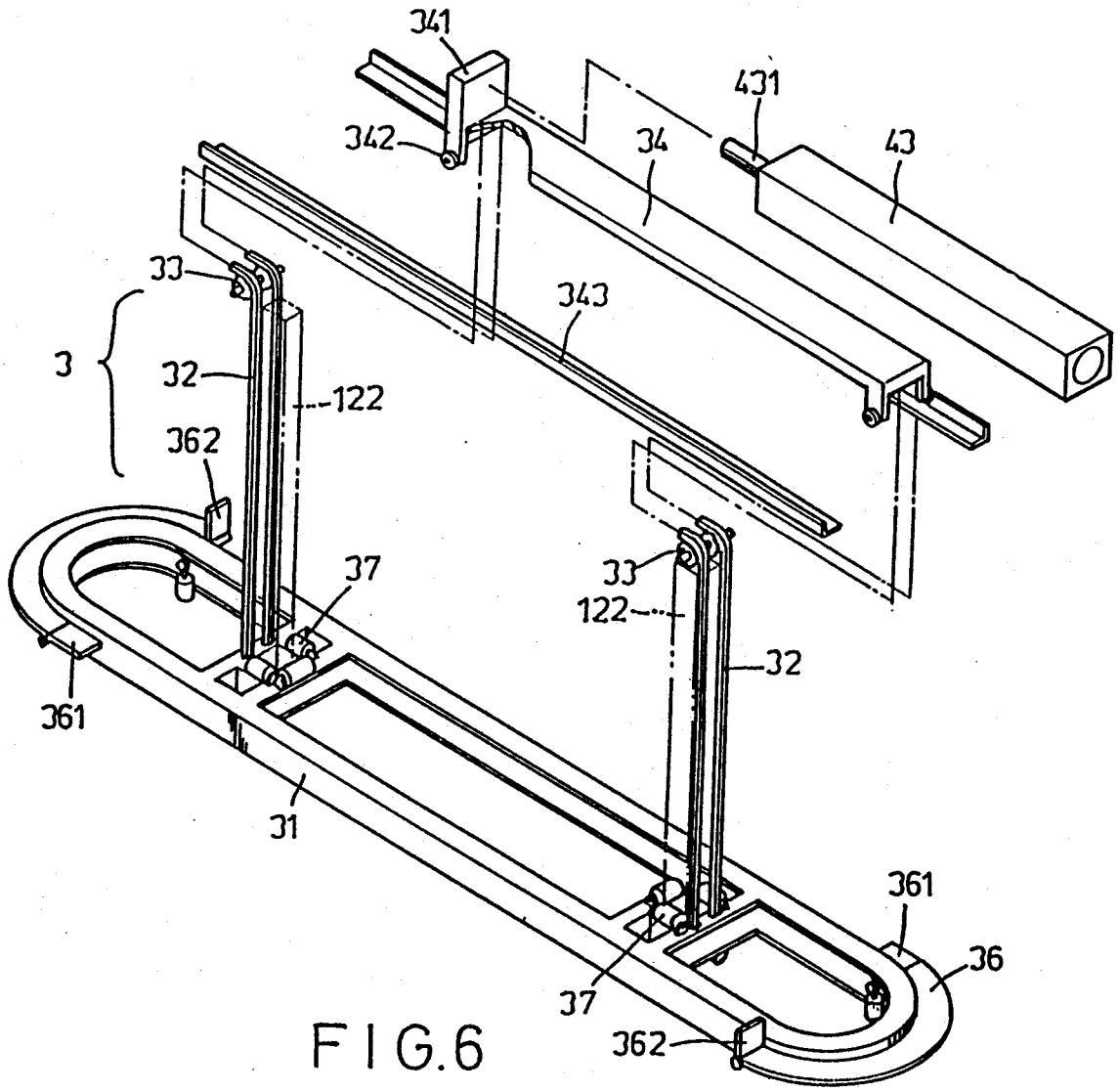
FIG. 6 is an exploded view showing an elevator means of FIG. 2.
Figure 7:
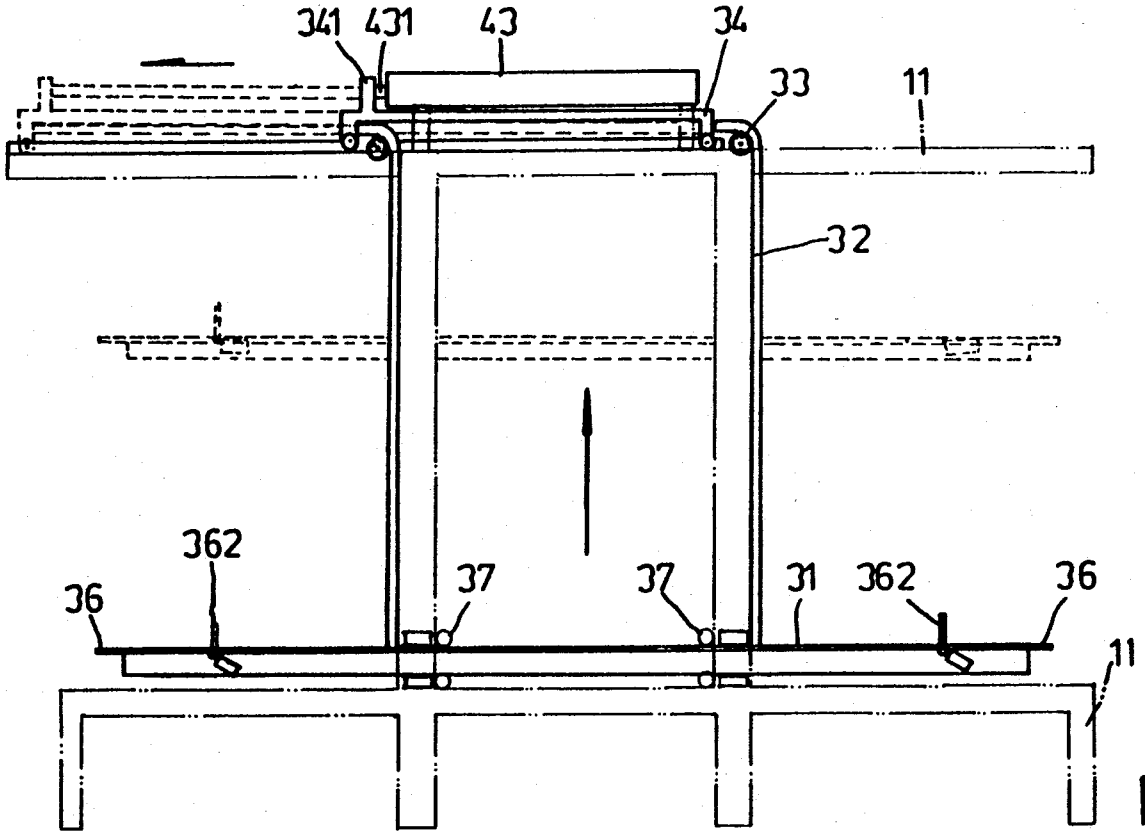
FIG. 7 is a plan view of FIG. 6 showing lifting movement by the phantom line.
Figure 8:
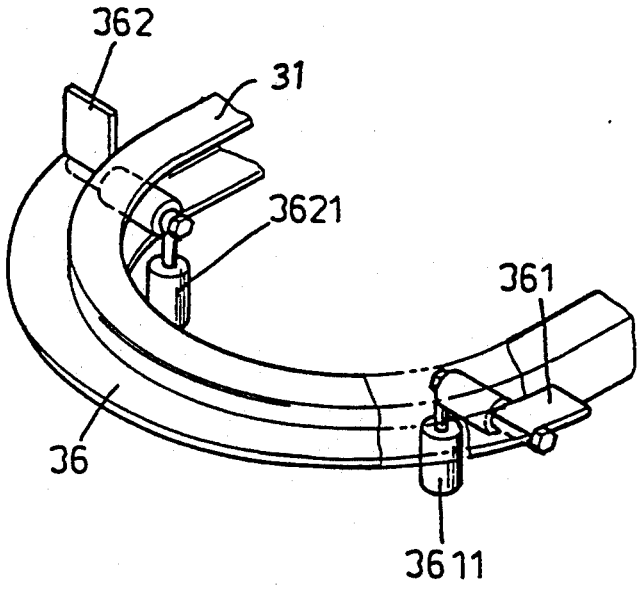
FIG. 8 is an enlarged perspective view showing an arcuate plate of the elevator means of FIG. 5.

The elevator means 3, shown in detail in FIGS. 6, 7 and 8 is composed of an elongated elevator 31 supported on top of the lower frame 11 by four guide supports 32 having one end connected to respective of the elevator 31 and the another end extending upwards and secured to respective ends of a U-shaped rod 34 and passing over four guide wheels 33. The rod 34 is located on top of the upper frame 11 and has a ledge 341 at one end extending upwardly and slides along two rails 343 on wheels 342. Two arcuate plates 36 extend outwards from respective ends of the elevator 31 and define two horizontal blocks 361, which are hinged to one side of respective plates 36, and two vertical blocks 362 which are hinged to the other side of respective plates 36. Each horizontal block 361 has a balancer 3611 secured to the hinged end to maintain blocks 361 in a horizontal position, whereas each block 362 has a balancer 3621 secured to the hinged end to maintain blocks 362 in an upright position. Two sets of rollers 37 are secured on the elevator 31 around the two posts 122 in such a manner that each side of the rectangular posts 122 contacts a roller 37 which functions as a guide preventing the elevator 31 from shaking when elevator 31 is actuated to move either upwards or downwards.

Figure 1:
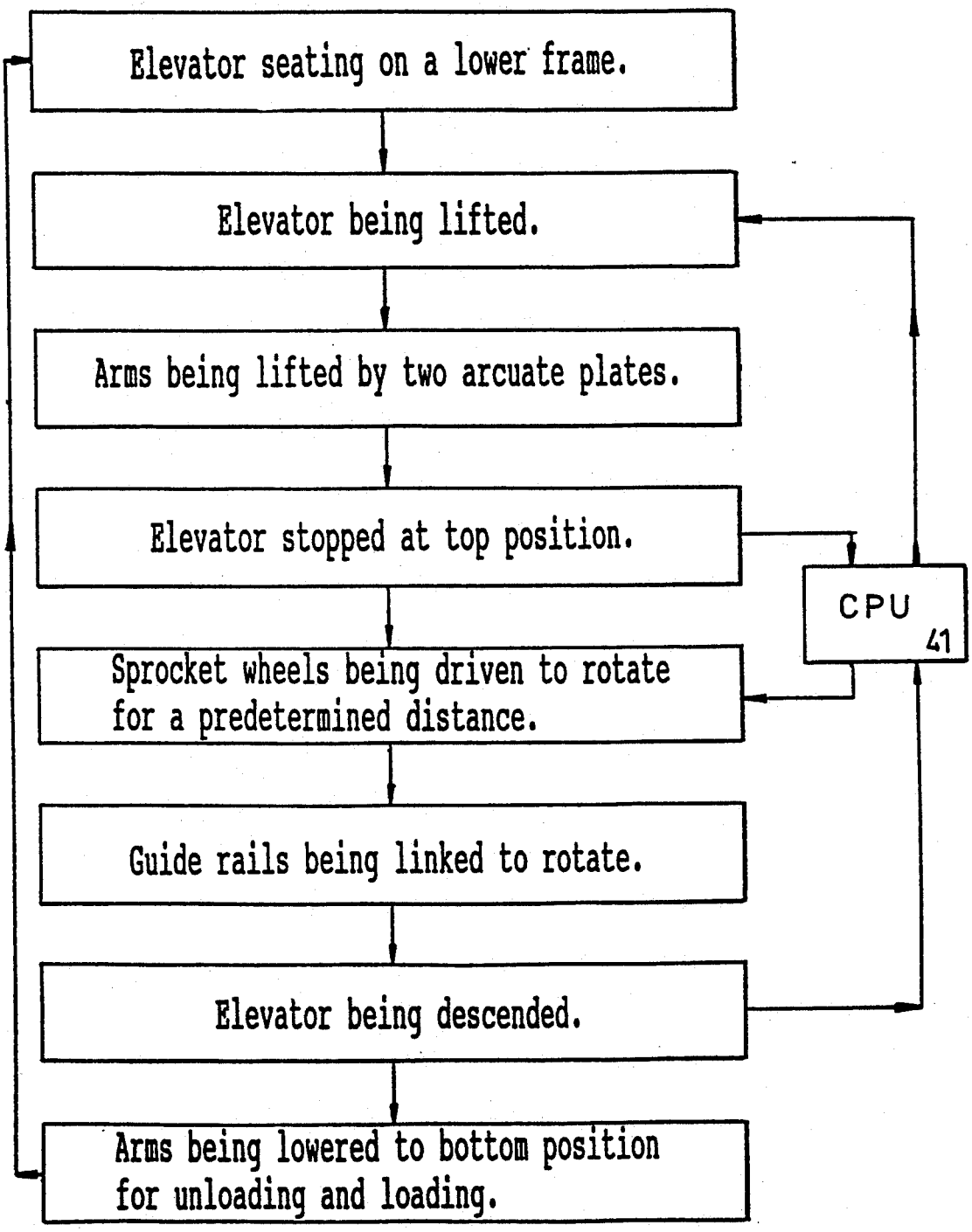
FIG. 1 is a flow chart showing the entire movement of the present invention.

The control means, schematically illustrated in FIG. 1 includes a central processing unit 41 which controls the entire movement of the present invention. A hydraulic operated motor 42 on top of the upper frame 11 is connected to one of the upper sprocket wheels 21, and a hydraulic operated cylinder 43 on top of the upper frame 11 having its shaft 431 connected to the ledge 341.

Figure 9:
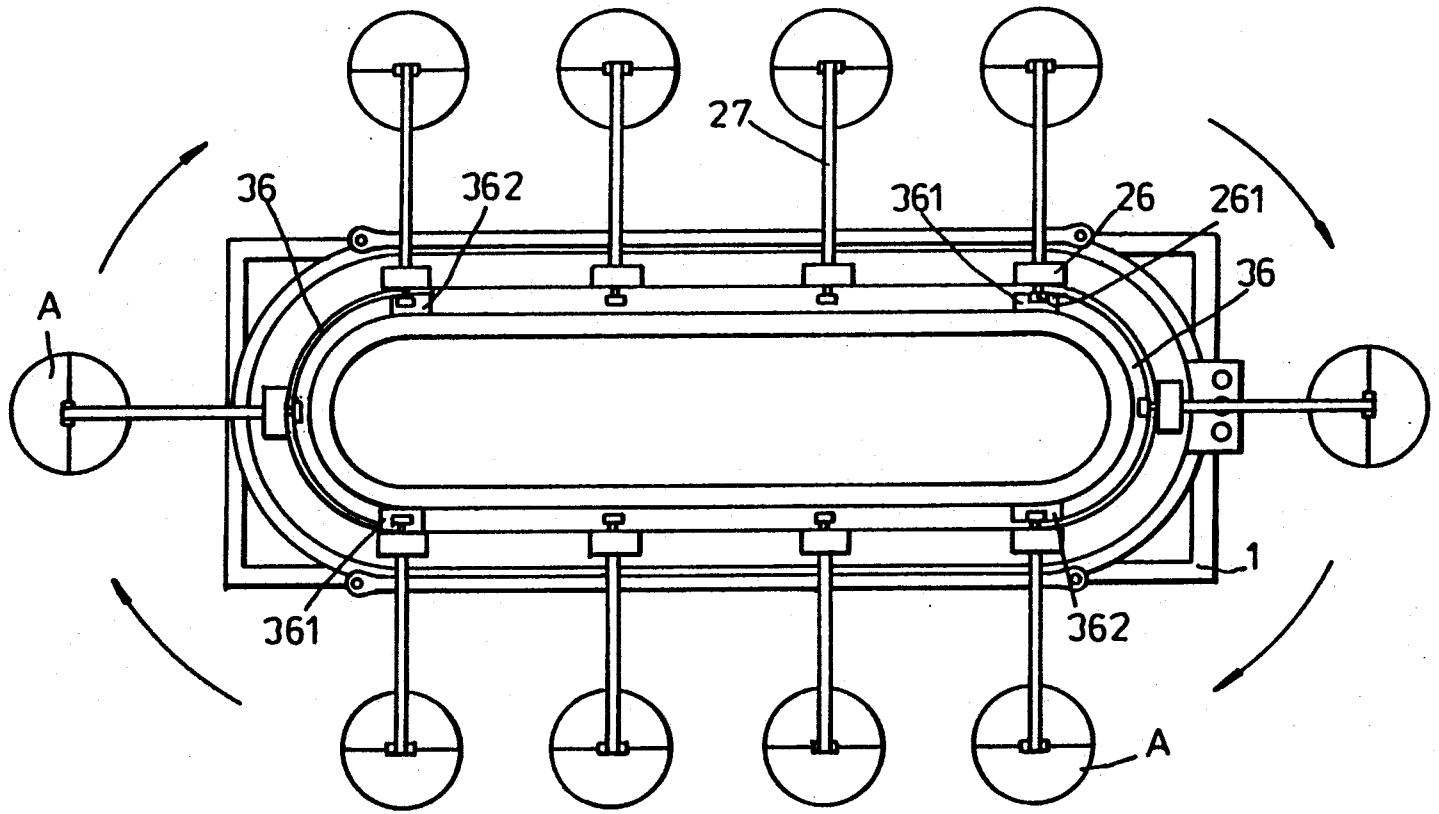
FIG. 9 is a top view of FIG. 2.
Figure 10:
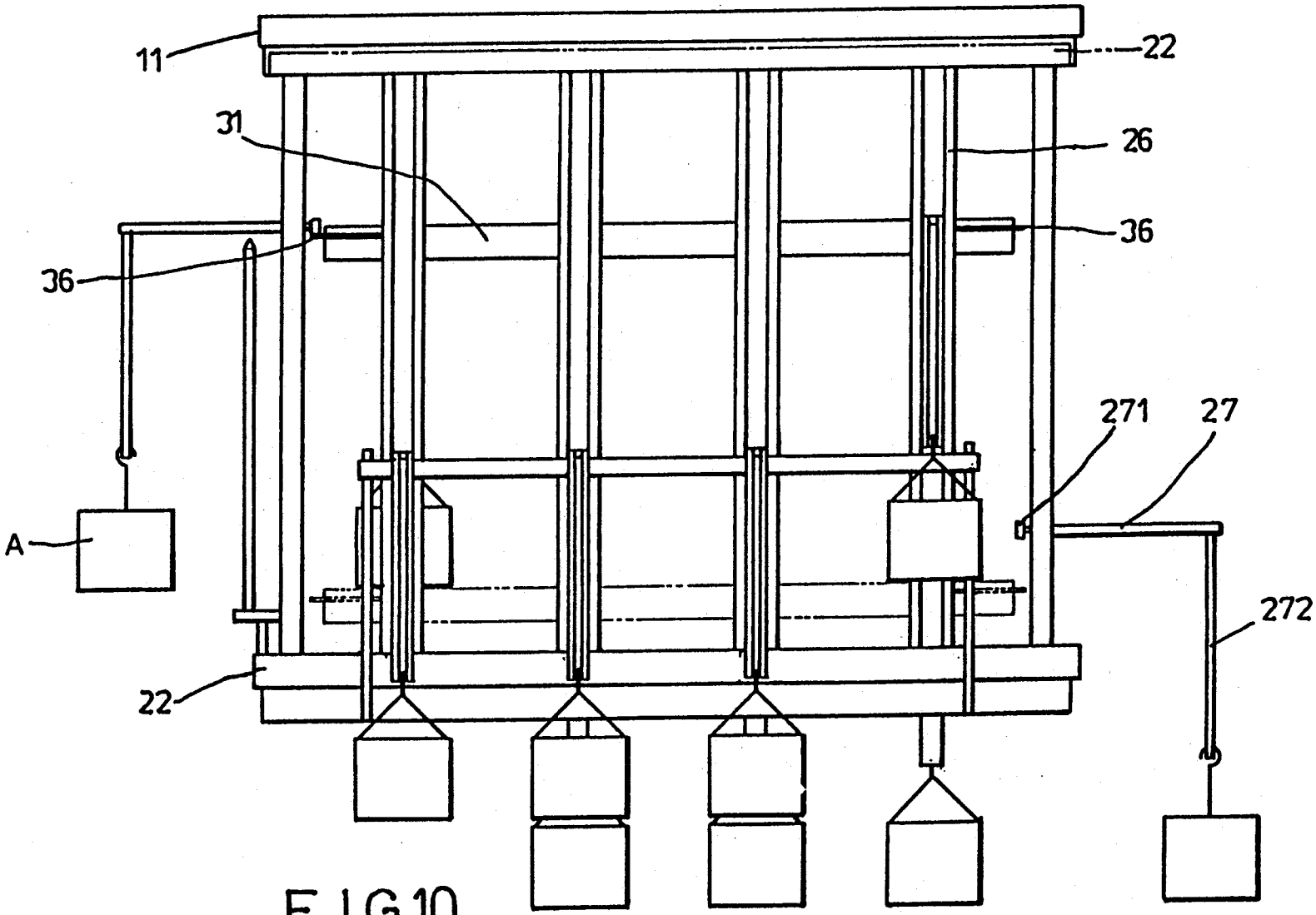
FIG. 10 is a front elevational view of the device of FIG. 9.
Figure 11A:
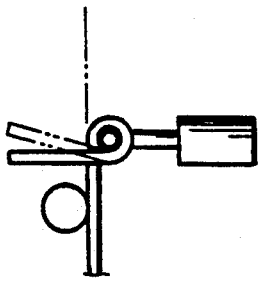
FIGS. 11*a*, 11*b* & 11*c* are schematic views showing a vertical block being pushed by an arm.
Figure 11B:
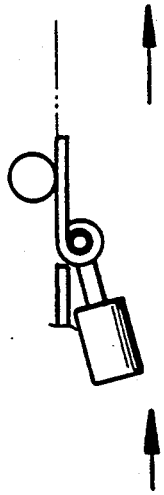
Figure 11C:
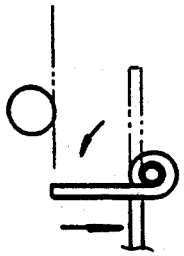
Figure 12A:
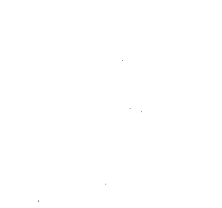
FIGS. 12*a*, 12*b*, 12*c* & 12*d* are schematic views showing a horizontal block being pushed upwards by an arm.
Figure 12B:
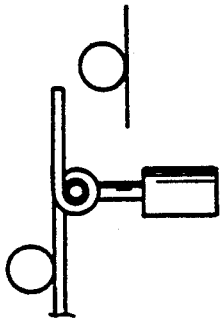
Figure 12C:
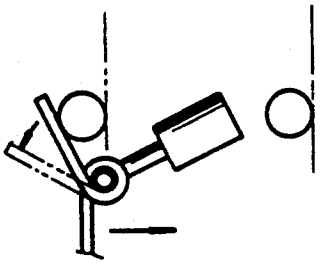
Figure 12D:
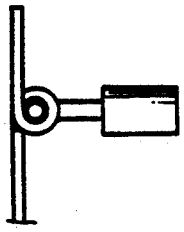

When a main switch is turned on, the central processing unit 41 will transmit a signal to order the hydraulic pump to pump oil into the cylinder 43 to push the shaft outwards, the ledge 341 is pushed simultaneously and the elevator 31 is lifted upwards via the guide supports 32 connected to the rod 34. The horizontal blocks 361 of plates 36 carry two arms 27 upwards, whereas, the blocks 362, because of its upright position, will bypass an arm 27 and be lifted unloaded. Once the movement of the shaft 431 is stopped, elevator 31 stops simultaneously. Cpu 44 then transmit a signal to order the motor 42 via the pump to rotate the sprocket wheels 21. The sprocket wheels 21 are linked to rotate simultaneously which switches the arms 27 on the blocks 361 to the next positions. The arms 27 seated on the blocks 361 of the plates 36 are moved to the middle position of the plates 36 and arms 27 seated on the middle positions of the plate 36 are moved towards the blocks 362, as shown in FIG. 9. The arms 27 moving towards blocks 362 from middle positions of the plates 36 will push the blocks 362 downwards gradually until blocks 362 are in a horizontal position and can no longer be pushed downwards, as shown in FIGS. 11*a*, 11*b*, & 11*c*. When motor 42 is stopped, Cpu 41 sends a signal to the cylinder 43 to retract the shaft 431 back into the cylinder 43 via the pump, such that the elevator 31 is lowered simultaneously. When elevator 31 has reached to its lowest position, the arms 27 originally carried by the block 362 will be stopped by two stoppers at the positions which are higher than the blocks 362 so that blocks 362 will bypass the arms 27 when elevator 31 is actuated to lift upwards at its next cycle, as shown in FIGS. 12*a*, 12*b*, 12*c* & 12*d*. The blocks 361, which are unloaded when the elevator is descending, will be urged upwards when engaging with the rollers 271 of the arm 27. Upon passing through the rollers 271, the blocks 361 will return to its original position. This has completed one cycle of the present invention in the dipping procedure.

A zinc bath is located at one side of the frame for hot dipping purposes and the other side of the frame is for loading purposes. When elevator 31 is lifted upwards, one arm 27 carried by the block 361 of one of the plates 36 is lifted up from the zinc bath, whereas, the other arm 27 carried on the middle position of the other plate 36 is lifted up across the wall of the bath and is brought into the zinc bath. The basket A hooked on the arm 27 coming out of the zinc bath may be unloaded.

We claim:

1. An automatic machine for hot dipping galvanization comprising a main frame, a slide means; an elevator means and a control means;

said main frame having a lower and an upper rectangular frame each having a plurality of beams transversely connected thereon, said upper frame being supported by two rectangular posts to stand above said lower frame;

said slide means having at least two pairs of sprocket wheels each of said pair having two sprocket wheels mounted at respective ends of said lower and upper frame, two link belts engaged said two pairs of sprocket wheels each of said link belts having a plurality of rollers and slidably located within two slideways, respectively, two shafts having one end of each connected to the center portion of each said lower sprocket wheel and the other end of said shafts connected to the center portion of each upper sprocket wheel to drive said lower sprocket wheels to rotate with said upper sprocket wheels; a plurality of guide rails each being formed with two U-shaped plates having opposite ends each U-shaped plates is secured to one of said link belts to be slide along with said link belts; a plurality of arms each having a first roller at one end, a crank swiveably mounted to the other end, each of said arm having said first roller extending outwards from one end thereof, a flange extending upwards from the same end, for second rollers mounted at four corners of said flange slidably installed within said guide rail for sliding within said guide rail, and a crank swiveably mounted at the other end; said elevator means having an elongated elevator positioned on top of said lower frame by at least four guide supports each having an end secured to said elevator and another end extending upwards and secured to a U-shaped rod via a guide wheel, a block offset from one end of said U-shaped rod, two arcuate plates extending outwards from opposite ends of said elevator, each arcuate plate having a horizontal block at one end for carrying an arm upwards and a vertical block at another end of said arcuate plate for carrying an arm downwardly, two sets of rollers being secured on the elevator, respectively;

said control means having a central processing unit controlling the entire movement, a motor connected with one of said sprocket wheels to rotate said sprocket wheels, a cylinder having a shaft connected with said flange of said U-shaped rod to lift and lower said elevator.

2. An automatic machine for hot dipping galvanization of claim 1, wherein each said horizontal block is connected with a balancer to maintain said horizontal block in a normally horizontal position; and wherein each said vertical block is connected to a balancer to maintain said vertical block in a normally upright position.

3. An automatic machine for hot dipping galvanization of claim 1, further comprising four third rollers attached to the elevator means and surrounding each of said rectangular posts in contact with each surface of said rectangular post as a guide to prevent said elevator from shaking.

* * * * *